US012623869B2

(12) United States Patent
Zhou

(10) Patent No.: US 12,623,869 B2
(45) Date of Patent: May 12, 2026

(54) CONTROL METHOD AND DEVICE OF OPTIONAL PAPER TRAY

(71) Applicant: Zhuhai Pantum Electronics Co., Ltd., Zhuhai (CN)

(72) Inventor: Xiaohua Zhou, Zhuhai (CN)

(73) Assignee: Zhuhai Pantum Electronics Co., Ltd., Zhuhai (CN)

( * ) Notice: Subject to any disclaimer, the term of this patent is extended or adjusted under 35 U.S.C. 154(b) by 23 days.

(21) Appl. No.: 18/751,339

(22) Filed: Jun. 24, 2024

(65) Prior Publication Data

US 2024/0425310 A1 Dec. 26, 2024

(30) Foreign Application Priority Data

Jun. 25, 2023 (CN) ..... 202310755849.9
Apr. 16, 2024 (CN) ..... 202410459354.6

(51) Int. Cl.
*B65H 1/14* (2006.01)
*B65H 3/06* (2006.01)
*B65H 7/04* (2006.01)

(52) U.S. Cl.
CPC ..... *B65H 1/14* (2013.01); *B65H 7/04* (2013.01); *B65H 2701/1313* (2013.01)

(58) Field of Classification Search
CPC ..... B65H 1/14; B65H 1/18; B65H 3/0669; B65H 3/06
See application file for complete search history.

(56) References Cited

U.S. PATENT DOCUMENTS 8,651,475 B2 2/2014 Matsui
2012/0104680 A1* 5/2012 Blair ..... G03G 15/6511 271/110
2014/0070480 A1* 3/2014 Taniguchi ..... B65H 1/08 271/18
2016/0159590 A1 6/2016 Zensai

FOREIGN PATENT DOCUMENTS

JP 2003341862 A * 12/2003
JP 3815250 B2 8/2006
JP 2008133082 A * 6/2008

OTHER PUBLICATIONS

The European Patent Office (EPO) The Extended European Search Report for Application No. 24183871.3 Nov. 25, 2024 7 Pages.

* cited by examiner

*Primary Examiner* — Luis A Gonzalez
(74) *Attorney, Agent, or Firm* — Anova Law Group, PLLC

(57) ABSTRACT

A control method and a control device of an optional paper tray are provided. The control method is applied to an image forming device, and include: according to a position of a bottom plate of the optional paper tray, determining whether a triggering condition for lifting the bottom plate is met; and using a paper feeding driving unit of the optional paper tray to drive the bottom plate of the optional paper tray to be lifted when the triggering condition for lifting the bottom plate is met. The paper feeding driving unit is used to transport paper in the optional paper tray.

20 Claims, 5 Drawing Sheets

CONTROL METHOD AND DEVICE OF OPTIONAL PAPER TRAY

CROSS-REFERENCE TO RELATED APPLICATION

This application claims the priority of Chinese Patent Application No. 202310755849.9, filed on Jun. 25, 2023, and Chinese Patent Application No. 202410459354.6, filed on Apr. 16, 2024, the contents of which are incorporated herein by reference in its entirety.

TECHNICAL FIELD

The present disclosure generally relates to the field of image forming technology and, more particularly, relates to a control method and device of an optional paper tray.

BACKGROUND

An image forming device is provided with different consumable accessories, such as ink cartridges, paper trays, etc. A paper tray is a component used to hold printing paper. The paper placed in the paper tray may be automatically fed and printed when printing. An optional paper tray is an expansion accessory of the image forming device provided by manufacturers to meet the printing needs of some users. The optional paper tray is different from the original paper tray that comes with the image forming device, and can provide additional paper storage capacity for the image forming device. During the printing process, the paper in the paper tray is fed into the image forming device for printing, and the paper in the paper tray will be gradually reduced. To prevent jams caused by the decreasing contact pressure between the paper and a paper feed roller because of the reduction of the number of paper, a bottom plate of the optional paper tray needs to be lifted. However, using a separate motor to lift the bottom plate will increase the cost of the optional paper tray. Therefore, how to lift the bottom plate of the optional paper tray while reducing costs is an issue that needs to be solved urgently.

SUMMARY

To resolve the foregoing problem existing in the prior art, an embodiment of the invention is provided a control method and device of an optional paper tray, the paper feeding driving unit in the optional paper tray may be responsible for paper feeding and lifting of the bottom plate. A stepper motor may be unnecessary for the optional paper tray, thereby reducing the cost of the optional paper tray.

One aspect of the present disclosure provides a control method of an optional paper tray. The control method is applied to an image forming device, and include: according to a position of a bottom plate of the optional paper tray, determining whether a triggering condition for lifting the bottom plate is met; and using a paper feeding driving unit of the optional paper tray to drive the bottom plate of the optional paper tray to be lifted when the triggering condition for lifting the bottom plate is met. The paper feeding driving unit is used to transport paper in the optional paper tray.

Another aspect of the present disclosure provides a control device of an optional paper tray. The control device includes: a position determination module configured to determine whether a triggering condition for lifting the bottom plate is met according to a position of a bottom plate of the optional paper tray; and a processing module configured to use a paper feeding driving unit of the optional paper tray to drive the bottom plate of the optional paper tray to be lifted when the triggering condition for lifting the bottom plate is met, where the paper feeding driving unit is used to transport paper in the optional paper tray.

Another aspect of the present disclosure provides an electronic device. The electronic device includes a processor, a memory, and a computer program. The computer program is stored in the memory, and includes instructions. When the instructions are executed, the electronic device is configured to: according to a position of a bottom plate of an optional paper tray, determine whether a triggering condition for lifting the bottom plate is met; and use a paper feeding driving unit of the optional paper tray to drive the bottom plate of the optional paper tray to be lifted when the triggering condition for lifting the bottom plate is met, wherein the paper feeding driving unit is used to transport paper in the optional paper tray.

Another aspect of the present disclosure provides an computer-readable storage medium the computer-readable storage medium comprising: a memory, and a computer program, wherein: the computer program is stored in the memory, and configured to be executed by the processor to implement a control method of an optional paper tray, the method comprising:

according to a position of a bottom plate of an optional paper tray, determine whether a triggering condition for lifting the bottom plate is met; and using a paper feeding driving unit of the optional paper tray to drive the bottom plate of the optional paper tray to be lifted when the triggering condition for lifting the bottom plate is met, wherein the paper feeding driving unit is used to transport paper in the optional paper tray.

Correspondingly, this application further provides a storage medium, where the storage medium includes a storage program, and when the storage program runs, a device on which the storage medium is located is controlled to perform the method described above.

In the present disclosure, the paper feeding driving unit in the optional paper tray may be responsible for paper feeding and lifting of the bottom plate. The switch between paper feeding and lifting of the bottom plate may be realized through switching the rotation status of the paper feeding driving unit. A stepper motor may be unnecessary for the optional paper tray, thereby reducing the cost of the optional paper tray.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

In order to better understand the technical scheme of this specification, embodiments of the invention are described in detail in combination with the attached drawings.

Reference will now be made in detail to exemplary embodiments of the disclosure, which are illustrated in the accompanying drawings. Wherever possible, the same reference numbers will be used throughout the drawings to refer to the same or like units. The embodiments disclosed herein are exemplary only. Other applications, advantages, alternations, modifications, or equivalents to the disclosed embodiments are obvious to those skilled in the art and are intended to be encompassed within the scope of the present disclosure.

It should be noted that the terms used in the embodiments of the present disclosure are only for the purpose of describing specific embodiments, and are not intended to limit the scope of the present disclosure. As used in the embodiments of the present disclosure and the appended claims, the singular forms such as "a", "said" and "the" are also intended to include the plural forms unless the context clearly indicates otherwise.

Figure 1:
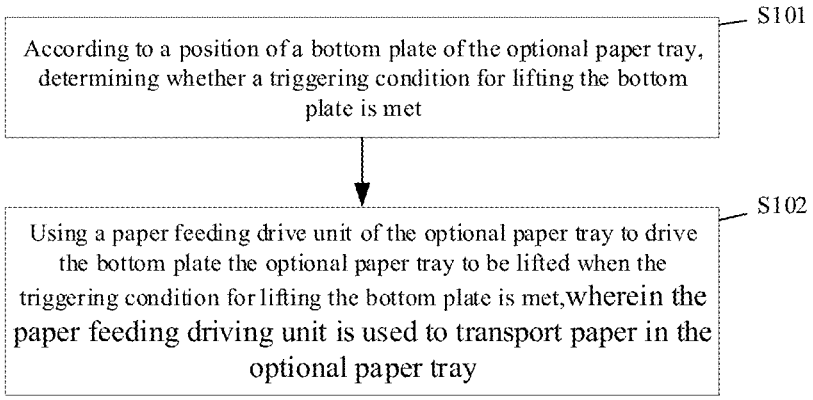
FIG. 1 illustrates a flowchart of an exemplary control method of an optional paper tray according to various disclosed embodiments of the present disclosure.

The present disclosure provides a control method of an optional paper tray, applied to an image forming device. FIG. 1 shows a flowchart of an exemplary control method of an optional paper tray. As shown in FIG. 1, in one embodiment, the method may include S101 and S102.

In S101, according to a position of a bottom plate of the optional paper tray, determining whether a triggering condition for lifting the bottom plate is met.

The optional paper tray may be provided with a sensor, and detection results of the sensor may be used to determine whether the position of the bottom plate of the optional paper tray meets the triggering condition for lifting the bottom plate. In one embodiment, the sensor may be implemented as a pressure sensor to detect the pressure between paper and a paper feed roller in the optional paper tray. Based on the pressure value detected by the pressure sensor, it may be determined whether the position of the bottom plate of the paper tray needs to be lifted. In another embodiment, the sensor may also be implemented as a height sensor to detect the height position of the bottom plate of the optional paper tray. Based on the height position of the bottom plate detected by the height sensor, it may be determined whether the bottom plate of the paper tray needs to be lifted.

The triggering condition for lifting the bottom plate may include that the position of the bottom plate of the optional paper tray is lower than a preset position. The preset position may be a position of the height sensor, or may be a minimum height position indicating that the paper in the optional paper tray is able to be successfully picked up.

In S102, using a paper feeding driving unit of the optional paper tray to drive the bottom plate of the optional paper tray to be lifted when the triggering condition for lifting the bottom plate is met, wherein the paper feeding driving unit is used to transport paper in the optional paper tray.

Based on the detection results of the sensor in S101, when it is determined that the triggering condition for lifting the bottom plate is met, it may be necessary to determine the paper feeding status of the paper feeding driving unit of the optional paper tray. The paper feeding status may be used to reflect whether the paper feeding driving unit is performing paper feeding operation. In one embodiment, the paper feeding status may be determined through whether the paper feeding driving unit is rotating in a first rotation state. The first rotation state may refer to the rotation direction of the paper feeding driving unit during the paper feeding operation, which may be forward rotation or reverse rotation. That is, the paper feeding driving unit may rotate forward to realize the paper feeding operation, and may also rotate in the reverse direction to realize the paper feeding operation. In one embodiment, whether the paper feeding operation is being performed may be determined according to whether the paper feeding driving unit is rotating in the forward rotation direction.

In some other embodiments, the paper feeding status of the paper feeding driving unit may also be determined according to whether the paper in the optional paper tray is within a designated driving range of the transportation path. When it is detected that the paper in the optional paper tray is within the specified driving range of the transportation path, it may be determined that the paper feeding driving unit is performing the paper feeding operation.

Figure 2:
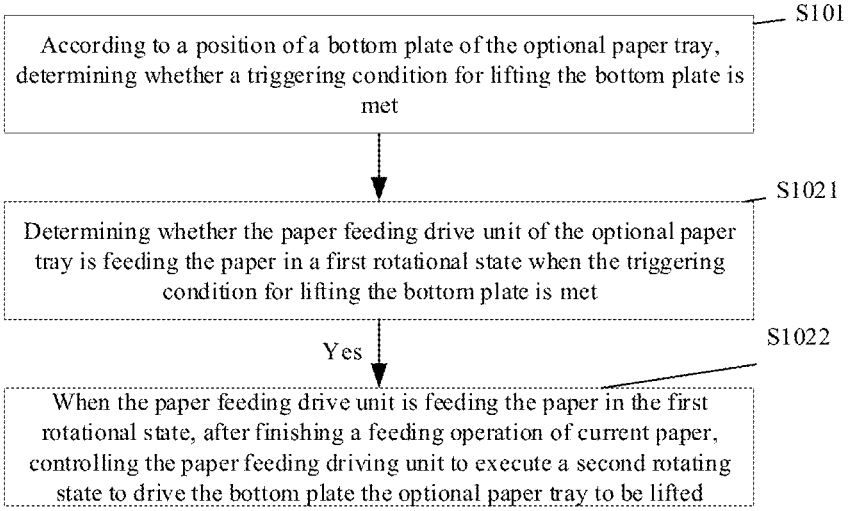
FIG. 2 illustrates a flowchart of another exemplary control method of an optional paper tray according to various disclosed embodiments of the present disclosure.

In another embodiment shown in FIG. 2 which is a flowchart of another exemplary control method of an optional paper tray, S102 may include S1021 and S1022.

In S1021, determining whether the paper feeding driving unit of the optional paper tray is feeding the paper in a first rotational state when the triggering condition for lifting the bottom plate is met.

The paper feeding driving unit may be embodied in the form of a driving motor in some embodiments. To ensure accuracy, the driving motor may be embodied in the form of a stepper motor. Since the bottom plate lifting and paper feeding are both driven by the paper feeding driving unit, the paper feeding driving unit may not be able to take care of the paper feeding and the bottom plate lifting at the same time. Therefore, it may be necessary to first determine whether the paper feeding driving unit is feeding paper to avoid affecting the lifting of the bottom plate. When the paper feeding driving unit is feeding paper, S1022 may be performed.

In S1022, when the paper feeding driving unit of the optional paper tray is feeding the paper in the first rotational state, after completing the paper feeding operation of the current paper, controlling the paper feeding driving to execute a second rotation state to drive the bottom plate of the optional paper tray to be lifted.

It may be possible to first determine whether the target paper being transported by the paper feeding driving unit has completed the paper feeding operation, and transportation of the next paper of the target paper may be controlled to suspend. After it is determined that the transportation of the target paper is completed, the paper feeding driving unit may be controlled to execute the second rotation state. Since the optional paper tray needs to feed the paper into the image forming device and then the image forming device itself transports the paper to printing components for printing, when it is detected that the rear end of the target paper left the driving range of the paper feeding driving unit, it may be determined that the target paper transportation is completed.

In some embodiments, the paper feeding driving unit may be connected to the paper feeding execution unit in the optional paper tray through a first transmission structure, and the paper feeding driving unit may be also connected to the bottom plate of the optional paper tray through a second transmission structure. In one embodiment, the paper feeding execution unit may be implemented in the form of a paper feed roller. When the paper feeding driving unit executes the first rotation state, the paper feeding driving unit may be controlled to rotate in the first direction and drive the paper feeding executing unit to move based on the first transmission structure. When the paper feeding execution unit moves, the optional paper tray may feed paper. When the paper feeding driving unit executes the second rotation state, the paper feeding driving unit may be controlled to rotate in the second direction and drive the bottom plate of the optional paper tray to move based on the second transmission structure.

Optionally, when the paper feeding driving unit is not feeding paper in the first rotational state, the paper feeding driving unit may be directly controlled to execute the second rotational state to lift the bottom plate of the optional paper tray.

In one embodiment, the paper feeding driving unit may be connected to the first transmission structure and the second transmission structure at the same time. When the paper feeding driving unit rotates, the first transmission structure and the second transmission structure may be driven at the same time. The above-mentioned first direction may be opposite to the second direction. The above-mentioned first rotation state may refer to the paper feeding driving unit rotating in the first direction, and the second rotation state may refer to to the paper feeding driving unit rotating in the second direction. For example, in one embodiment, the first direction may be the forward rotation direction of the paper feeding driving unit, and the corresponding second direction may be the reverse rotation direction of the paper feeding driving unit. For example, the forward rotation direction may be clockwise rotation, and the reverse rotation direction may be counterclockwise rotation.

When it is determined that the bottom plate of the optional paper tray needs to be lifted, whether the paper feeding driving unit is feeding paper may be determined first. When the paper feeding driving unit is feeding paper, the bottom plate may be kept stationary and the transportation of the next paper may be paused, while the paper feeding driving unit continues normally to complete the delivery of the paper currently being transported. Then the paper feeding driving unit may be controlled to start to reverse to lift the bottom plate. In one embodiment, a ratchet structure may be used in the second transmission structure (for example, a gear of a bicycle, which can only drive the bicycle forward when it rotates forward, and cannot drive the bicycle backward when it rotates reversely), thereby preventing the paper feeding driving unit from causing the bottom plate to drop when it rotates forward to feed paper. When the paper feeding driving unit reverses and lifts the bottom plate, the transportation of the next paper of the target paper may be temporarily paused and the next paper may not be fed into the driving range of the paper feeding driving unit. Therefore, when the paper feeding driving unit reverses and lifts the bottom plate, the rotational state of the first transmission structure and the paper feeding execution unit may be opposite to that of the forward paper feeding. But since there is no paper to be transported within the driving range at this time, there may be no impact.

In the above embodiment, the paper feeding driving unit may rotate forward to feed paper and rotate reverse to lift the bottom plate, thereby eliminating one stepper motor and saving the cost of an optional paper tray.

In the above embodiments, since the paper feeding driving unit is only able to lift the bottom plate through reverse rotation but is not able to lower the bottom plate through forward rotation, a support device may be provided in the bottom plate to support the bottom plate and ensure that the bottom plate will not descend in the printing process. When the user needs to add paper to the optional paper tray, the optional paper tray may be pulled out. When the optional paper tray is pulled out, the support device may be triggered to release the support for the bottom plate of the optional paper tray, causing the bottom plate to drop and the user is able to add paper normally.

In some embodiments, to improve processing efficiency and shorten operation time, when the triggering condition for lifting the bottom plate is met and the paper feeding driving unit of the optional paper tray is performing the paper feeding operation in the first rotation state, the paper feeding driving unit may switch to the second rotation state to control lifting of the bottom plate of the optional paper tray without waiting for the current paper feeding operation to complete before performing the bottom plate lifting operation.

In some other embodiments, to improve operational convenience, different transmission structures may be used to implement the paper feeding operation and the bottom plate lifting in the same rotational state. For example, the first transmission structure may implement the paper feeding operation in the first rotational state, and the second transmission structure may implement the bottom plate lifting operation in the second rotation state. The first rotation state and the second rotation state may be the same rotation state or the same rotation direction. For example, the first rotation state and the second rotation state may be both forward rotation (or clockwise rotation) direction, or the first rotation state and the second rotation state may be both reverse rotation (or counterclockwise rotation).

In some other embodiments, to overcome the problem that the paper feeding driving unit cannot control the lowering of the bottom plate in the above embodiments, the paper feeding driving unit may be only connected to one transmission structure when implementing different operations. During the printing process, the paper feeding driving unit may be only connected to the first transmission structure and may be used to drive the paper feeding execution unit to feed paper. When the bottom plate of the optional paper tray needs to be raised or lowered, the paper feeding driving unit may be disconnected from the first transmission structure and may be connected to the second transmission structure. Subsequently, the paper feeding driving unit may control the lifting and/or lowering of the bottom plate through forward and reverse rotation respectively. That is, the first rotation state may specifically refer to the state in which the paper feeding driving unit rotates when connected to the first transmission structure, and the second rotation state may specifically refer to the state in which the paper feeding driving unit rotates when connected to the second transmission structure. For example, a gear may be provided on the rotating structure of the paper feeding driving unit. When the paper feeding driving unit is in the first rotational state to feed paper, the gear of the paper feeding driving unit may mesh with a gear on the first transmission structure, to drive the paper feeding execution unit to feed paper. When the bottom plate of the optional paper tray needs to be raised or lowered, the gear of the paper feeding driving unit may be moved to be separated from the first transmission structure and engage with the gear on the second transmission structure, thereby controlling the lift or lowering of the bottom plate of the optional paper tray.

In some embodiments, after pausing paper feeding and controlling the paper feeding driving unit to execute the second rotation state, when it is detected that the triggering condition to stop lifting the bottom plate is met, the paper feeding driving unit may be controlled to stop executing the second rotation state, and then the paper feeding driving unit may be controlled to execute the first rotation state to resume paper feeding. In one embodiment, when the bottom plate of the optional paper tray is lifted to the target position, the triggering condition to stop lifting the bottom plate may be determined to be met. The target position to which the bottom plate needs to be lifted may be determined based on the number of papers remaining in the optional paper tray, or may be determined based on the distance between the paper in the paper tray and the paper feed roller.

In some embodiments, there may be an optional paper tray failure, resulting in the bottom plate never being lifted into place. Therefore, the lifting time may be constrained, to avoid the situation where the optional paper tray is lifting the bottom plate continuously in the event of a failure. For example, when the lifting duration of the bottom plate of the optional paper tray is larger than a first threshold, it may be determined that the triggering condition to stop lifting the bottom plate is detected. The size of the first threshold may be calculated based on the height of the optional paper tray and the driving speed of the paper feeding driving unit.

Figure 3:
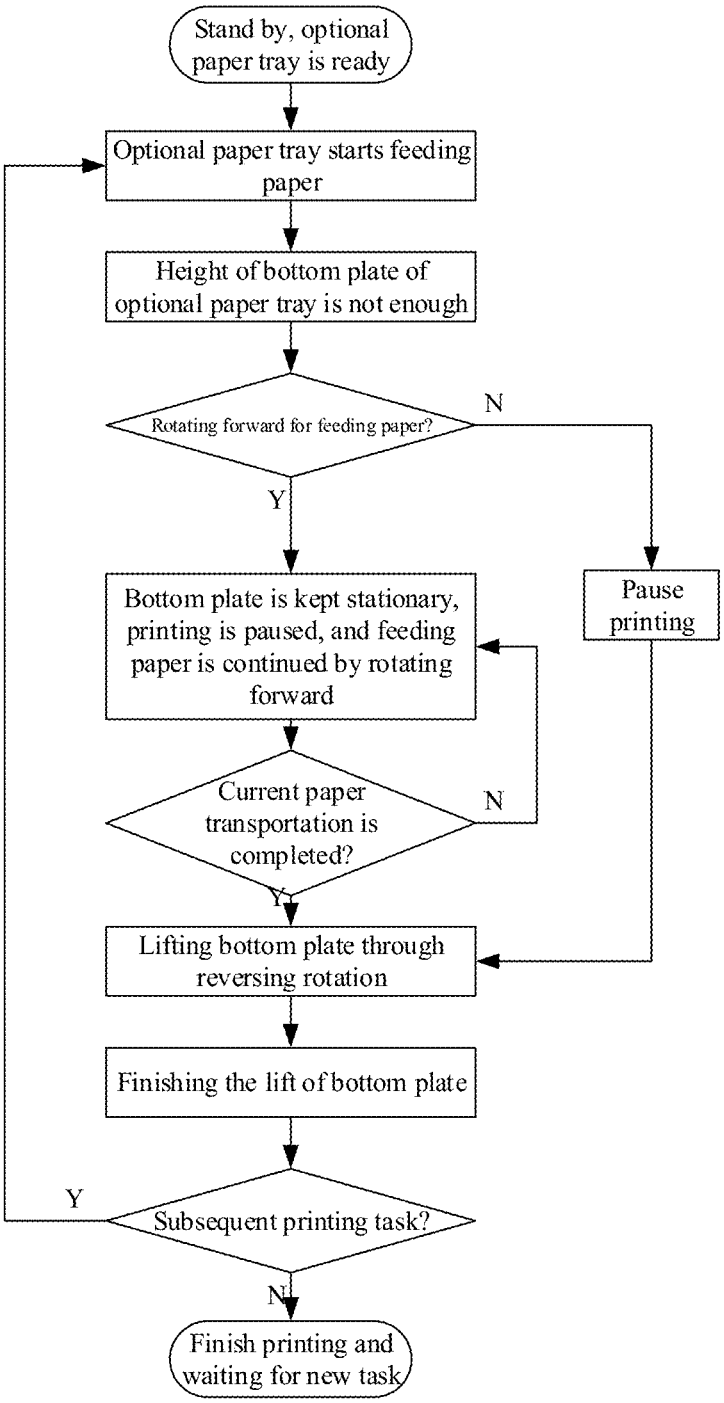
FIG. 3 illustrates a flowchart of another exemplary control method of an optional paper tray according to various disclosed embodiments of the present disclosure.

In some embodiments, when the optional paper tray is feeding paper, the image forming device may be in printing operation. Therefore, when the bottom plate needs to be lifted to pause paper feeding, printing may also need to be paused. FIG. 3 is a flow chart of another control method of an optional paper tray. As shown in FIG. 3, after the user installs the optional paper tray to the image forming device, the image forming device and the optional paper tray may authenticate each other. After passing the authentication, when there is no current printing task, the image forming device may enter the standby state, and the optional paper tray may be in the ready state. When the image forming device receives the print task and starts printing, the optional paper tray may start feeding paper into the image forming device. During printing, whether the bottom plate of the optional paper tray needs to be lifted may be periodically checked. When it is detected that the bottom plate of the optional paper tray is not high enough, whether the paper feeding driving unit is rotating forward for feeding paper may be determined. When the paper feeding driving unit is not currently rotating forward for feeding paper, printing may be paused and then directly the rotation may be reversed to lift the bottom plate.

When the paper feeding driving unit is currently feeding paper in forward rotation, the bottom plate may be kept stationary and printing may be paused. At the same time, the paper feeding driving unit may continue to rotate forward to complete the transportation of the piece of paper currently being transported. During the paper feeding process, the image forming device may send paper feeding instructions to the paper feeding driving unit in units of one piece of paper. Therefore, the paper feeding driving unit may suspend receiving the paper feeding task (that is, the paper feeding timing may be controlled to pause the paper feeding of the next paper in the tray). After the sensor determines that the paper being transported is out of the driving range of the paper feeding driving unit, it may be determined that the current paper transportation is completed and lifting the bottom plate through reversing rotation may be started. In another embodiment, based on the real-time changes of the sensor on the optional path, it may be possible to calculate when the rear end of the current forward-rotating paper transfer departs from the driving range of the paper feeding driving unit. Based on this, after a little margin may be given to deal with the delay caused by mechanical slippage and other factors in the paper feeding, the forward rotation paper feeding may be stopped and the reverse rotation may be started to lift the bottom plate. In another embodiment, a rear sensor may be installed in the optional paper tray. When the bottom plate is not high enough and the rear sensor recognizes that the forward paper feeding is completed, the forward paper feeding may be stopped and the reverse rotation may be started to lift the bottom plate.

Timing may be started after entering the lifting of the bottom plate through reverse rotation. During timing, whether the bottom plate is lifted to the target position may be detected in real time. When it is detected that the bottom plate is lifted to the target position within a preset time period, the paper feeding driving unit may be controlled to stop reverse rotation and it may be determined that the bottom plate lifting action is completed. Then whether there are subsequent print tasks may be determined, and if there are subsequent print tasks, printing may be resumed. When there are no subsequent printing tasks, printing may end to wait for new tasks. When the bottom plate is not detected to be lifted into the target position within the preset time period, the paper feeding driving unit may be also controlled to stop lifting the bottom plate through reverse rotation and resume printing. For example, when the lifting time of the bottom plate of the optional paper tray is larger than the first threshold, it may be determined that the triggering condition for stopping the lift of the bottom plate is met, and it may be considered as the end of the lift. That is, no matter whether the bottom plate is lifted to the target position or not, as long as the lifting is completed, the printing paper feeding sequence may be entered.

In the present disclosure, the paper feeding driving unit in the optional paper tray may be responsible for paper feeding and lifting of the bottom plate. A stepper motor may be unnecessary for the optional paper tray, thereby reducing the cost of the optional paper tray.

Figure 4:
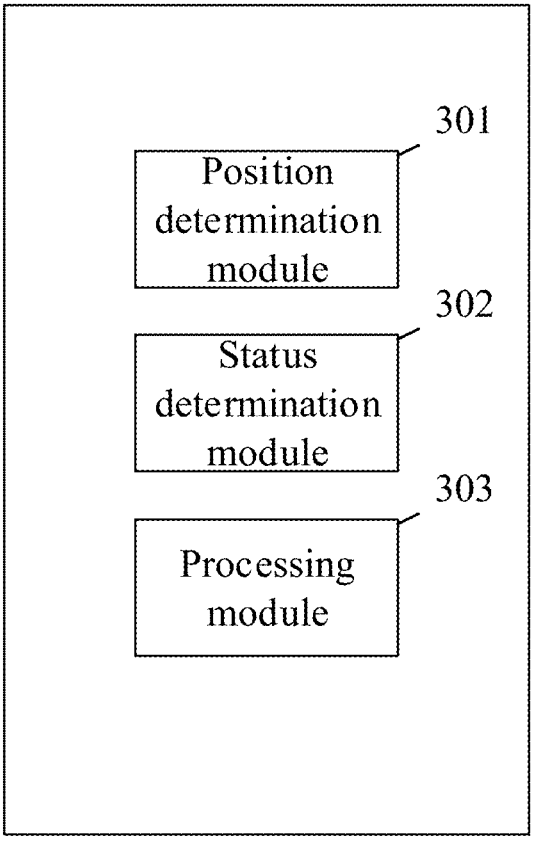
FIG. 4 illustrates an exemplary control derive of an optional paper tray according to various disclosed embodiments of the present disclosure.

The present disclosure also provides a control device of an optional paper tray. In one embodiment shown in FIG. 4 which illustrates an exemplary control device of an optional paper tray, the control device may include a position determination module 301, a status determination module 302, and a processing module 303.

The position determination module 301 may be configured to determine whether a triggering condition for lifting a bottom plate is met based on the position of the bottom plate of the optional paper tray. The processing module 303 may be configured to use a paper feeding driving unit of the optional paper tray to drive the bottom plate of the optional paper tray to be lifted when the position of the bottom plate of the optional paper tray meets the triggering condition for lifting the bottom plate.

The status determination module 302 may be connected to the processing module 303, and may be configured to determine the rotation status of the paper feeding driving unit of the optional paper tray when the position of the bottom plate of the optional paper tray meets the triggering condition for lifting the bottom plate and send the rotation status of the paper feeding driving unit to processing module 303.

In some embodiments, the processing module 303 may be also configured to: when it is determined that the paper feeding driving unit is feeding paper in the first rotational state according to the status determination module 302, control the paper feeding driving unit to execute the second rotation state to drive the bottom plate of the optional paper tray to be lifted after completing the paper feeding operation of the current paper; and when it is determined that the paper feeding driving unit is not feeding paper in the first rotation state according to the status determination module 302, control the paper feeding driving unit to execute the second rotation state to drive the bottom plate of the optional paper tray to be lifted.

In some embodiments, the processing module 303 may be also configured to pause paper feeding and control the paper feeding driving unit to execute the second rotation state when the paper feeding driving unit of the optional paper tray is feeding paper in the first rotation state. When the paper driving unit is in the second rotation state, the bottom plate of the optional paper tray may be lifted accordingly.

In some embodiments, the paper feeding driving unit may be connected to the paper feeding execution unit in the optional paper tray through a first transmission structure, and the paper feeding driving unit may be also connected to the bottom plate of the optional paper tray through a second transmission structure.

When the paper feeding driving unit executes the first rotation state, the processing module 303 may control the paper feeding driving unit to rotate in the first direction, to drive the paper feeding execution unit to move based on the first transmission structure.

When the paper feeding driving unit executes the second rotation state, the processing module 303 may control the paper feeding driving unit to rotate in the second direction, to drive the bottom plate of the optional paper tray to move based on the second transmission structure.

In some embodiments, the first direction may be opposite to the second direction.

In some embodiments, the processing module 303 may be configured to: determine whether the target paper being transported by the paper feeding driving unit has completed the paper feeding operation, and control to suspend transportation of the next paper of the target paper; and, when it is determined that the transportation of the target paper is completed, control the paper feeding driving unit to execute the second rotation state.

In some embodiments, the processing module 303 may be configured to: determine that the transportation of the target paper is completed after detecting that the rear end of the target paper leaves the driving range of the paper feeding driving unit.

In some embodiments, the processing module 303 may be also configured to: when it is detected that the triggering condition for stopping the lift of the bottom plate is met, control the paper feeding driving unit to stop executing the second rotation state.

In some embodiments, when the bottom plate is raised to the target position, or when the lifting duration of the bottom plate is greater than the first threshold, the triggering condition for for stopping the lift of the bottom plate may be determined to be met.

For details about the control method of the optional paper tray provided by various embodiments of the present disclosure, references may be made to the above description about the optional paper tray.

Figure 5:
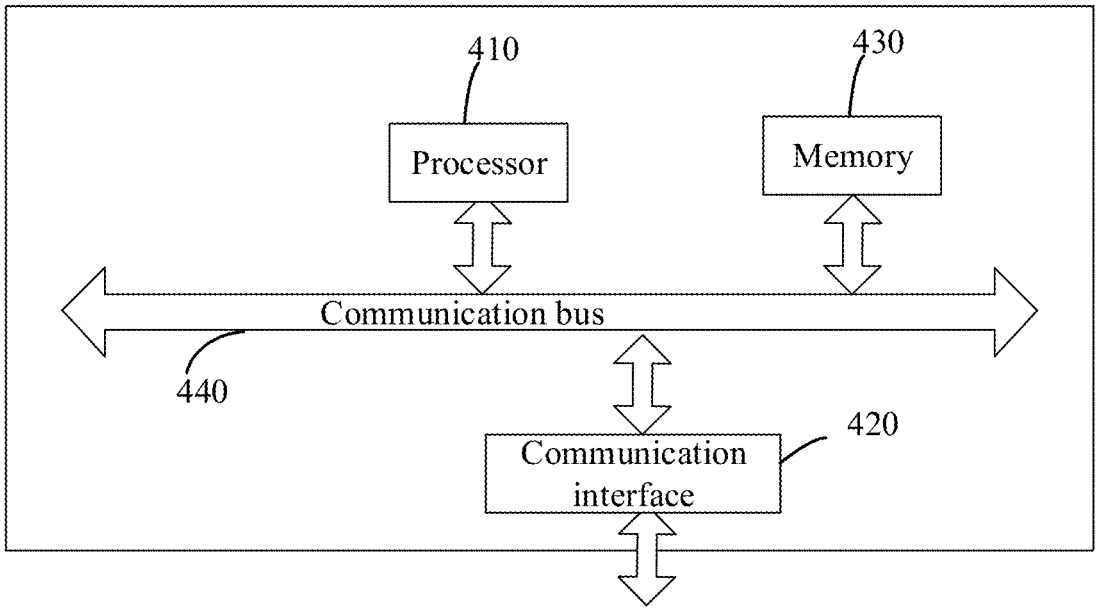
FIG. 5 illustrates an exemplary electronic device according to various disclosed embodiments of the present disclosure.

The present disclosure also provides an electronic device. In one embodiment, as shown in FIG. 5, the electronic device may include a processor, a memory, and a computer program. The computer program may be stored in the memory and may include instructions. When the instructions are executed, the electronic device may be controlled to execute a control method of an optional paper tray provided by various embodiments of the present disclosure.

In one embodiment shown in FIG. 5, the electronic device may be implemented as a general computing device. The components of the electronic device may include, but are not limited to: one or more processors 410, a communication interface 420, a memory 430, and a communication bus 440 connecting different system components (including the memory 430, the communication interface 420, and the one or more processors 410).

The communications bus 440 may include one or more of several types of bus structures, including a memory bus or memory controller, a peripheral bus, a graphics accelerated port, a processor, or a local bus using any of a variety of bus structures. For example, these architectures include but are not limited to an industry standard architecture (ISA) bus, a micro channel architecture (MAC) bus, an enhanced ISA bus, a video electronics standards association (VESA) local area bus or a peripheral component interconnection (PCI) bus.

The electronic device may typically include a variety of computer system readable media. These media may be any available media that can be accessed by the electronic device, including volatile or nonvolatile media, removable or non-removable media.

The memory 430 may include computer system readable media in the form of volatile memory, such as random access memory (RAM) and/or cache memory. The electronic devices may further include other removable/non-removable, volatile/non-volatile computer system storage media. The memory 430 may include at least one program product having a set of (e.g., at least one) program modules configured to perform the functions of various embodiments of the present disclosure.

A program/utility having a set of (at least one) program modules, including but not limited to an operating system, one or more application programs, other program modules, and program data, may be stored in memory 430. Each of these examples or some combination may include the implementation of a network environment. The program modules may generally perform functions and/or methods in the embodiments described in the present disclosure.

The processor 410 may execute various functional applications and data processing by running programs stored in the memory 430, for example, implementing the control method of the optional paper tray provided by the embodiments shown in FIGS. 1 to 3 of the present disclosure.

The present disclosure also provides a computer-readable storage medium. The computer-readable storage medium may be configured to store computer instructions. The computer instructions may cause a computer where the storage medium is located to execute the control method of the optional paper tray provided by the embodiments shown in FIG. 1 to FIG. 3 in the present disclosure.

The above computer-readable storage medium may be any combination of one or more computer-readable media. The computer-readable medium may be a computer-readable signal medium or a computer-readable storage medium. The computer-readable storage medium may be, for example, but is not limited to, an electrical, magnetic, optical, electromagnetic, infrared, or semiconductor system, apparatus or device, or any combination thereof. More specific examples (non-exhaustive list) of computer readable storage media include: an electrical connection having one or more conductors, a portable computer disk, a hard drive, random access memory (RAM), read only memory (ROM), Erasable Programmable Read Only Memory (EPROM) or flash memory, optical fiber, portable compact disk read-only memory (CD-ROM), optical storage device, magnetic memory parts, or any suitable combination of the above. As used herein, a computer-readable storage medium may be any tangible medium that contains or stores a program for use by or in connection with an instruction execution system, apparatus, or device.

The embodiments disclosed herein are exemplary only. Other applications, advantages, alternations, modifications, or equivalents to the disclosed embodiments are obvious to those skilled in the art and are intended to be encompassed within the scope of the present disclosure. In some cases, the actions or steps recited in the present disclosure may be performed in an order different from that in the embodiments and still achieve desirable results. In addition, the processes depicted in the accompanying figures do not necessarily require the particular order shown, or sequential order, to achieve desirable results. Multitasking and parallel processing may be also possible or may be advantageous in certain embodiments.

Any process or method descriptions in flowcharts or otherwise described herein may be understood to represent modules, segments or portions of code comprising one or more executable instructions for implementing custom logical functions or steps of a process, and the scope of preferred embodiments of this specification includes alternative implementations in which functions may be performed out of the order shown or discussed, including in substantially simultaneous fashion or in reverse order depending on the functions involved.

Devices involved in the embodiments of the present disclosure may include, but are not limited to, personal computers (PC), personal digital assistants (PDA), wireless handheld devices, tablet computers, mobile phones, MP3 monitors, MP4 monitors, etc.

In the present disclosure, the disclosed systems, devices or methods can be implemented in other ways. For example, the device embodiments described above are only illustrative. For example, the division of the units is only a logical function division. In actual implementation, there may be other division methods. For example, multiple units or components may be combined or may be integrated into another system, or some features may be ignored or not implemented. In another point, the mutual coupling or direct coupling or communication connection shown or discussed may be through some interfaces, and the indirect coupling or communication connection of devices or units may be in electrical, mechanical or other forms. Each functional unit in each embodiment of the present disclosure may be integrated into one processing unit, or each unit may exist separately physically, or two or more units may be integrated into one unit. The above-mentioned integrated units can be implemented in the form of hardware, or in the form of hardware plus software functional units.

The integrated units implemented in the form of software functional units may be stored in a non-transitory computer-readable storage medium. The above-mentioned software functional units may be stored in a storage medium, including several instructions to enable a computer device (which may be a personal computer, a connector, or a network device, etc.) or a processor to execute a portion of the methods described in each embodiment of the present disclosure. The aforementioned storage media may include medium that can store program code such as a flash disk, a mobile hard disk, read-only memory (ROM), random access memory (RAM), magnetic disk or optical disc, etc.

The embodiments disclosed herein are exemplary only. Other applications, advantages, alternations, modifications, or equivalents to the disclosed embodiments are obvious to those skilled in the art and are intended to be encompassed within the scope of the present disclosure.

What is claimed is:

1. A control method of an optional paper tray, performed by an image forming device, the method comprising:

according to a position of a bottom plate of the optional paper tray, determining whether a triggering condition for lifting the bottom plate is met;

determining whether the paper feeding driving unit of the optional paper tray is feeding the paper in a first rotational state when the triggering condition for lifting the bottom plate is met; and using a paper feeding driving unit of the optional paper tray to drive the bottom plate of the optional paper tray to be lifted when the triggering condition for lifting the bottom plate is met, wherein the paper feeding driving unit is used to transport paper in the optional paper tray.

2. The method according to claim 1, wherein using the paper feeding driving unit of the optional paper tray to drive the bottom plate of the optional paper tray to be lifted when the triggering condition for lifting the bottom plate is met includes:

when the paper feeding driving unit of the optional paper tray is feeding the paper in the first rotational state, after finishing a feeding operation of current paper, controlling the paper feeding driving unit to execute a second rotating state to drive the bottom plate of the optional paper tray to be lifted; and when the paper feeding driving unit is not feeding the paper in the first rotational state, controlling the paper feeding driving unit to execute a second rotating state to drive the bottom plate of the optional paper tray to be lifted.

3. The method according to claim 1, wherein:

the paper feeding driving unit is connected to a paper feeding execution unit in the optional paper tray through a first transmission structure, and the paper feeding driving unit is also connected to the bottom plate of the optional paper tray through a second transmission structure;

when the paper feeding driving unit executes the first rotation state, a gear of the paper feeding driving unit engages with a gear on the first transmission structure to drive the paper feeding execution unit to feed paper; and when the paper feeding driving unit executes the second rotation state, the gear of the paper feeding driving unit is moved to be separated from the first transmission structure and engage with a gear on the second transmission structure to control lift or lowering of the bottom plate of the optional paper tray.

4. The method according to claim 2, wherein after finishing the feeding operation of the current paper, controlling the paper feeding driving unit to execute the second rotating state, includes:

determining whether target paper being transported by the paper feeding driving unit completes the paper feeding operation, and suspending transportation of next paper of the target paper; and when it is determined that the transportation of the target paper is completed, controlling the paper feeding driving unit to execute the second rotational state.

5. The method according to claim 4, wherein determining whether the target paper being transported by the paper feeding driving unit completes the paper feeding operation, includes:

when it is detected that a rear end of the target paper leaves a driving range of the paper feeding driving unit, determining that the transportation of the target paper is completed.

6. The method according to claim 2, wherein after controlling the paper feeding driving unit to execute the second rotation state, further including:

when it is detected that a triggering condition for stopping the lift of the bottom plate is met, controlling the paper feeding driving unit to stop executing the second rotation state.

7. The method according to claim 6, wherein:

the triggering condition for stopping the lift of the bottom plate includes that the bottom plate is lifted to a target position or a duration for lifting the bottom plate is larger than a first threshold.

8. A control device of an optional paper tray, comprising:

a memory, a processor, and a computer program, wherein the computer program is stored in the memory and configured to perform:

determining whether a triggering condition for lifting the bottom plate is met according to a position of a bottom plate of the optional paper tray;

determining whether the paper feeding driving unit of the optional paper tray is feeding the paper in a first rotational state when the triggering condition for lifting the bottom plate is met; and using a paper feeding driving unit of the optional paper tray to drive the bottom plate of the optional paper tray to be lifted when the triggering condition for lifting the bottom plate is met, wherein the paper feeding driving unit is used to transport paper in the optional paper tray.

9. The device according to claim 8, wherein the processor is configured to:

when the paper feeding driving unit of the optional paper tray is feeding the paper in the first rotational state, after finishing a feeding operation of current paper, controlling the paper feeding driving unit to execute a second rotating state to drive the bottom plate of the optional paper tray to be lifted; and when the paper feeding driving unit is not feeding the paper in the first rotational state, controlling the paper feeding driving unit to execute a second rotating state to drive the bottom plate of the optional paper tray to be lifted.

10. The device according to claim 8, wherein:

the paper feeding driving unit is connected to a paper feeding execution unit in the optional paper tray through a first transmission structure, and the paper feeding driving unit is also connected to the bottom plate of the optional paper tray through a second transmission structure;

when the paper feeding driving unit executes the first rotation state, a gear of the paper feeding driving unit engages with a gear on the first transmission structure to drive the paper feeding execution unit to feed paper; and when the paper feeding driving unit executes the second rotation state, the gear of the paper feeding driving unit is moved to be separated from the first transmission structure and engage with a gear on the second transmission structure to control lift or lowering of the bottom plate of the optional paper tray.

11. The device according to claim 9, wherein the processor is further configured to:

determine whether target paper being transported by the paper feeding driving unit completes the paper feeding operation, and suspending transportation of next paper of the target paper; and when it is determined that the transportation of the target paper is completed, control the paper feeding driving unit to execute the second rotational state.

12. The device according to claim 9, wherein determining whether the target paper being transported by the paper feeding driving unit completes the paper feeding operation, includes:

when it is detected that a rear end of the target paper leaves a driving range of the paper feeding driving unit, determining that the transportation of the target paper is completed.

13. The device according to claim 9, wherein the processor is further configured to: after controlling the paper feeding driving unit to execute the second rotation state, further including:

when it is detected that a triggering condition for stopping the lift of the bottom plate is met, controlling the paper feeding driving unit to stop executing the second rotation state.

14. The device according to claim 13, wherein the triggering condition for stopping the lift of the bottom plate includes that the bottom plate is lifted to a target position or a duration of lifting the bottom plate is larger than a first threshold.

15. A non-transitory computer-readable storage medium, comprising: a memory, and a computer program, wherein:

the computer program is stored in the memory, and configured to be executed by a processor to implement a control method of an optional paper tray, the method comprising:

according to a position of a bottom plate of an optional paper tray, determine whether a triggering condition for lifting the bottom plate is met;

determining whether the paper feeding driving unit of the optional paper tray is feeding the paper in a first rotational state when the triggering condition for lifting the bottom plate is met; and using a paper feeding driving unit of the optional paper tray to drive the bottom plate of the optional paper tray to be lifted when the triggering condition for lifting the bottom plate is met, wherein the paper feeding driving unit is used to transport paper in the optional paper tray.

16. The non-transitory computer-readable storage medium according to claim 15, wherein using the paper feeding driving unit of the optional paper tray to drive the bottom plate of the optional paper tray to be lifted when the triggering condition for lifting the bottom plate is met includes:

when the paper feeding driving unit of the optional paper tray is feeding the paper in the first rotational state, after finishing a feeding operation of current paper, controlling the paper feeding driving unit to execute a second rotating state to drive the bottom plate of the optional paper tray to be lifted; and when the paper feeding driving unit is not feeding the paper in the first rotational state, controlling the paper feeding driving unit to execute a second rotating state to drive the bottom plate of the optional paper tray to be lifted.

17. The non-transitory computer-readable storage medium according to claim 15, wherein:

the paper feeding driving unit is connected to a paper feeding execution unit in the optional paper tray through a first transmission structure, and the paper feeding driving unit is also connected to the bottom plate of the optional paper tray through a second transmission structure;

when the paper feeding driving unit executes the first rotation state, the paper feeding driving unit is controlled to rotate in a first direction, to drive the paper feeding execution unit to move based on the first transmission structure; and when the paper feeding driving unit executes the second rotation state, the paper feeding driving unit is controlled to rotate in a second direction, to drive the bottom plate of the optional paper tray to move based on the second transmission structure.

18. The non-transitory computer-readable storage medium according to claim 16, wherein after finishing the feeding operation of the current paper, controlling the paper feeding driving unit to execute the second rotating state, includes:

when the paper feeding driving unit executes the first rotation state, a gear of the paper feeding driving unit engages with a gear on the first transmission structure to drive the paper feeding execution unit to feed paper; and when the paper feeding driving unit executes the second rotation state, the gear of the paper feeding driving unit is moved to be separated from the first transmission structure and engage with a gear on the second transmission structure to control lift or lowering of the bottom plate of the optional paper tray.

19. The non-transitory computer-readable storage medium according to claim 18, wherein determining whether the target paper being transported by the paper feeding driving unit completes the paper feeding operation, includes:

when it is detected that a rear end of the target paper leaves a driving range of the paper feeding driving unit, determining that the transportation of the target paper is completed.

20. The non-transitory computer-readable storage medium according to claim 16, wherein after controlling the paper feeding driving unit to execute the second rotation state, further including:

when it is detected that a triggering condition for stopping the lift of the bottom plate is met, controlling the paper feeding driving unit to stop executing the second rotation state.

* * * * *